US012515247B2

(12) United States Patent
De Giorgio et al.

(10) Patent No.: US 12,515,247 B2
(45) Date of Patent: Jan. 6, 2026

(54) TORSION GUIDE, GUIDE APPARATUS AND CORRESPONDING METHOD

(71) Applicant: DANIELI & C. OFFICINE MECCANICHE S.P.A., Buttrio (IT)

(72) Inventors: Tiziano De Giorgio, Udine (IT); Salvatore Capra, San Giovanni al Natisone (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 271 days.

(21) Appl. No.: 18/253,918

(22) PCT Filed: Nov. 9, 2021

(86) PCT No.: PCT/IT2021/050366
§ 371 (c)(1),
(2) Date: May 22, 2023

(87) PCT Pub. No.: WO2022/113136
PCT Pub. Date: Jun. 2, 2022

(65) Prior Publication Data

US 2024/0091836 A1 Mar. 21, 2024

(30) Foreign Application Priority Data

Nov. 24, 2020 (IT) ..... 102020000028157

(51) Int. Cl.
*B21B 39/16* (2006.01)
*B21B 1/16* (2006.01)

(52) U.S. Cl.
CPC ..... *B21B 39/165* (2013.01); *B21B 1/16* (2013.01); *B21B 2267/24* (2013.01)

(58) Field of Classification Search
CPC ..... B21B 39/14; B21B 39/28; B21B 39/165; B21B 1/16; B21B 2267/24
See application file for complete search history.

(56) References Cited

U.S. PATENT DOCUMENTS 4,039,107 A * 8/1977 Boley ..... B21B 39/165 72/250
6,237,387 B1 * 5/2001 Yoshizawa ..... B21B 39/165 72/251

FOREIGN PATENT DOCUMENTS

| | | |
|---|---|---|
| CN | 209663975 U | 11/2019 |
| EP | 3254774 A1 | 12/2017 |
| JP | S55 177908 U | 12/1980 |
| JP | H0671323 A | 3/1994 |

OTHER PUBLICATIONS

Applicant: Daniel & C. Officine Meccaniche S.p.A.; "Torsion Guide, Guide Apparatus and Corresponding Method"; International Application No. PCT/IT2021/050366 Filed Nov. 9, 2021; PCT International Search Report and Written Opinion dated Mar. 1, 2022; 8 pgs.

* cited by examiner

*Primary Examiner* — Teresa M Ekiert
(74) *Attorney, Agent, or Firm* — Tarolli, Sundheim, Covell & Tummino LLP

(57) ABSTRACT

Torsion guide (10) comprising a support body (11) with which there are associated at least two torsion rollers (12, 13) rotatable around respective parallel rotation axes (T1, T2), distanced with respect to each other at least in a direction of adjustment (B) perpendicular to said rotation axes (T1, T2) and disposed on respective support elements (17, 18).

10 Claims, 2 Drawing Sheets

TORSION GUIDE, GUIDE APPARATUS AND CORRESPONDING METHOD

CROSS-REFERENCE TO RELATED APPLICATIONS

This application is a U.S. National Stage Application filed under 35 U.S.C. § 371 of PCT/IT2021/050366, filed Nov. 9, 2021, and entitled "TORSION GUIDE, GUIDE APPARATUS AND CORRESPONDING METHOD", which claims priority from Italian Patent Application No. 102020000028157, filed on Nov. 24, 2020. The entire contents of each of the above-identified patent applications are incorporated herein by reference.

FIELD OF THE INVENTION

Embodiments described here concern a torsion guide that can be used in rolling long metal products to guide and position the metal products as they exit a rolling stand.

In particular, the present invention concerns a torsion guide suitable to modify the angular positioning of long metal products with a circular, oval, square, or polygonal section.

The invention also concerns a guide apparatus in which said torsion guide is used, and a corresponding guide method.

BACKGROUND OF THE INVENTION

The rolling of long metal products with a circular section, such as bars, round pieces, rod, wire, or other similar products is known, which provides the progressive reduction of the thickness of these metal products by means of cylinders or rollers of rolling stands located in succession along a rolling axis.

It is also known that, when the stands are disposed in sequence with a horizontal axis, a long metal product, exiting a rolling stand, can have an oval cross section defined by a major axis and a minor axis offset by 90°. At exit from the rolling stand, the metal product is positioned with the minor axis perpendicular to the rotation axis of the rollers, or cylinders, of the rolling stand.

To correctly roll the metal product, and to obtain the desired decrease in thickness and the expected elongation, it is therefore necessary to twist the metal product at exit from the rolling stand before the entrance of the next one. Generally, the total torsion required is about 90°, and the torsion axis coincides with the rolling axis. In this way, the metal product enters the next rolling stand with the major axis perpendicular to the rotation axis of the cylinders or rollers.

To obtain this torsion it is known to use a torsion guide interposed with the rolling stands.

Known torsion guides generally comprise a pair of conical or truncated cone-shaped torsion rollers, associated with a support body and having rotation axes parallel to each other and belonging to a common plane orthogonal to the rolling axis.

The torsion rollers are normally idle and kept constantly in contact with the rolled metal products, from which they receive, by friction, the rotational motion.

The two torsion rollers are disposed in such a way as to converge in opposite directions. Furthermore, they are normally overlapping in a direction perpendicular to the rolling axis and their rotation axes, and distanced from each other in a direction parallel to their rotation axes. For example, in the case of a rolling train with a horizontal axis, the two torsion rollers are overlapping in the vertical direction and distanced from each other in the horizontal direction.

Between the two torsion rollers there is thus defined a passage gap into which the metal product enters, which contacts the torsion rollers in their conical portion, which give it a first torsion. This first torsion is identifiable in the difference in inclination of the cross section of the metal product between upstream and downstream of the torsion guide and is a function of the reciprocal positioning of the torsion rollers, in particular of the distance between them in the direction of overlap.

The total torsion of the metal product, on the other hand, is identifiable in the difference in inclination of the cross section thereof between upstream of the torsion guide and the entrance to the next rolling stand. The total torsion depends on the extent of the first torsion transmitted by the torsion rollers, on the pitch between the two successive rolling stands and on the location of the torsion guide between the two stands.

Furthermore, documents CN 209 663 975 U and JP S55 177908 U 20 are known, which concern rolling apparatuses comprising two rollers pivoted to respective mobile support elements.

One disadvantage of torsion guides known in the state of the art is that the reciprocal positioning of the torsion rollers is set manually by one or more operators who intervene directly on the guide. In fact, it is known that the operators suitably distance the torsion rollers, taking into account the gaps provided in the rolling tables and the distance between the rolling stands.

This disadvantage is particularly disadvantageous because it requires the operator, or the team of operators, to intervene promptly on each torsion guide along the rolling train. This can be disadvantageous both in economic terms and in safety for the operators.

Furthermore, it is also known that prolonged contact between the metal product and the torsion rollers causes the progressive wear thereof, with the consequent loss of the correct reciprocal positioning. This disadvantage is particularly disadvantageous and can lead to an incorrect positioning of the metal product and therefore to a low quality of the final product or to blockages during rolling.

To overcome this, known torsion guides require further frequent and burdensome manual repositioning of the torsion rollers in the course of operations, which entail further disadvantages in economic terms and in safety for the operators.

There is therefore a need to perfect a torsion guide which can overcome at least one of the disadvantages of the state of the art.

In particular, one purpose of the present invention is to provide a torsion guide that reduces, or eliminates, the manual intervention of the operators for setting and adjusting it.

Yet another purpose is to perfect a rolling method and plant that allow to guarantee the high quality of the rolled metal product, reducing maintenance interventions and the risks of blockages.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes, a torsion guide is described that overcomes the limits of the state of the art and eliminates the defects present therein.

The torsion guide of the present invention comprises a support body provided with an inlet and an outlet for a metal product, which are aligned along a rolling axis. At least two torsion rollers, rotatable around respective rotation axes parallel to each other and perpendicular to the rolling axis, are associated with the support body.

The torsion rollers are overlapping and distanced from each other in a direction of adjustment perpendicular to their rotation axes and to the rolling axis.

According to one aspect of the invention, the torsion rollers are pivoted to respective support elements which are mobile at least in parallel to an adjustment axis and are mechanically connected to at least one motor mean. Furthermore, according to one aspect of the present invention, the torsion guide comprises a control and management unit and one or more means for detecting the reciprocal position of the torsion rollers at least in a direction parallel to the adjustment axis. The detection means are configured to transmit data correlated to the position of the torsion rollers to the control and management unit in order to allow to adjust the reciprocal position of the torsion rollers at least in a direction parallel to the adjustment axis.

In preferred embodiments, the motor mean is mechanically connected to both support elements in order to move them in a coordinated way and, moreover, with the movement of the support elements there corresponds a reciprocal movement of the torsion rollers toward/away from each other.

In preferred embodiments, the torsion guide comprises a support body provided with an inlet and an outlet for a metal product which are aligned along a rolling axis, and the support elements are disposed symmetrically with respect to the rolling axis.

In preferred embodiments, the control and management unit is configured to command the functioning of the at least one motor mean at least as a function of the data correlated to the position of the torsion rollers, in order to adjust the reciprocal position thereof at least in a direction parallel to the adjustment axis.

In preferred embodiments, the support elements each comprise a disk rotatable around a respective axis of rotation and on which a respective torsion roller is eccentrically pivoted by means of a rotation support.

In preferred embodiments, the disks are integral with respective toothed wheels which engage common grub screw element that can be driven by the at least one motor mean, and the detection means comprise transducers of the angular position of the disks.

The present invention also concerns a guide apparatus for rolling stands disposed in sequence along a rolling axis. The apparatus comprises at least one torsion guide in accordance with the present invention and a rolling guide disposed downstream of the torsion guide along the rolling axis. The rolling guide comprises guide rollers and means for detecting the force applied by a metal product in transit on the guide rollers, which are configured to transmit data relating to the force applied to the guide rollers to the control and management unit, whereby the adjustment of the reciprocal position of the torsion rollers is subjected to the detection of the force by the force detection means.

The present invention also concerns a rolling plant comprising at least two rolling stands disposed in succession along a rolling axis. The rolling plant also comprises at least one torsion guide according to the present invention placed between two rolling stands of the plant.

In addition, a rolling guide can be disposed in the plant, placed downstream of the torsion guide and upstream of one of the rolling stands. The rolling guide comprises at least two guide rollers, with which there are associated one or more means for detecting the force that, during use, the metal product applies thereto. These detection means are configured to transmit data relating to the force applied to the guide rollers to a control and management unit. The control and management unit can command the motor mean of the torsion guide as a function of the data received from the detection means of the rolling guide.

The present invention also concerns a rolling method that provides to:

- reduce the thickness of a metal product by means of a first rolling stand;
- transmit a first torsion to the metal product at exit from the first rolling stand by means of a torsion guide provided with at least two torsion rollers pivoted to respective support elements which are mobile at least in parallel to an adjustment axis and are mechanically connected to at least one motor mean, a control and management unit and one or more means for detecting the position of the torsion rollers at least in a direction parallel to the adjustment axis, which are configured to transmit data correlated to the position of the torsion rollers to the control and management unit;
- directly or indirectly detect the wear of the torsion rollers;
- automatically adjust the reciprocal position of the torsion rollers, at least in a direction parallel to the adjustment axis, on the basis of the wear of the torsion rollers detected.

In preferred embodiments, the detection of the wear of the torsion rollers occurs by means of the control and management unit which analyzes data transmitted by means for detecting the force applied by the metal product to one or more guide rollers of a rolling guide located downstream of the torsion guide.

In preferred embodiments, the automatic adjustment of the reciprocal position of the torsion rollers occurs by moving them by means of the motor mean commanded by the control unit.

BRIEF DESCRIPTION OF THE DRAWINGS

These and other aspects, characteristics and advantages of the present invention will become apparent from the following description of some embodiments, given as a non-restrictive example with reference to the attached drawings wherein.

Figure 2:
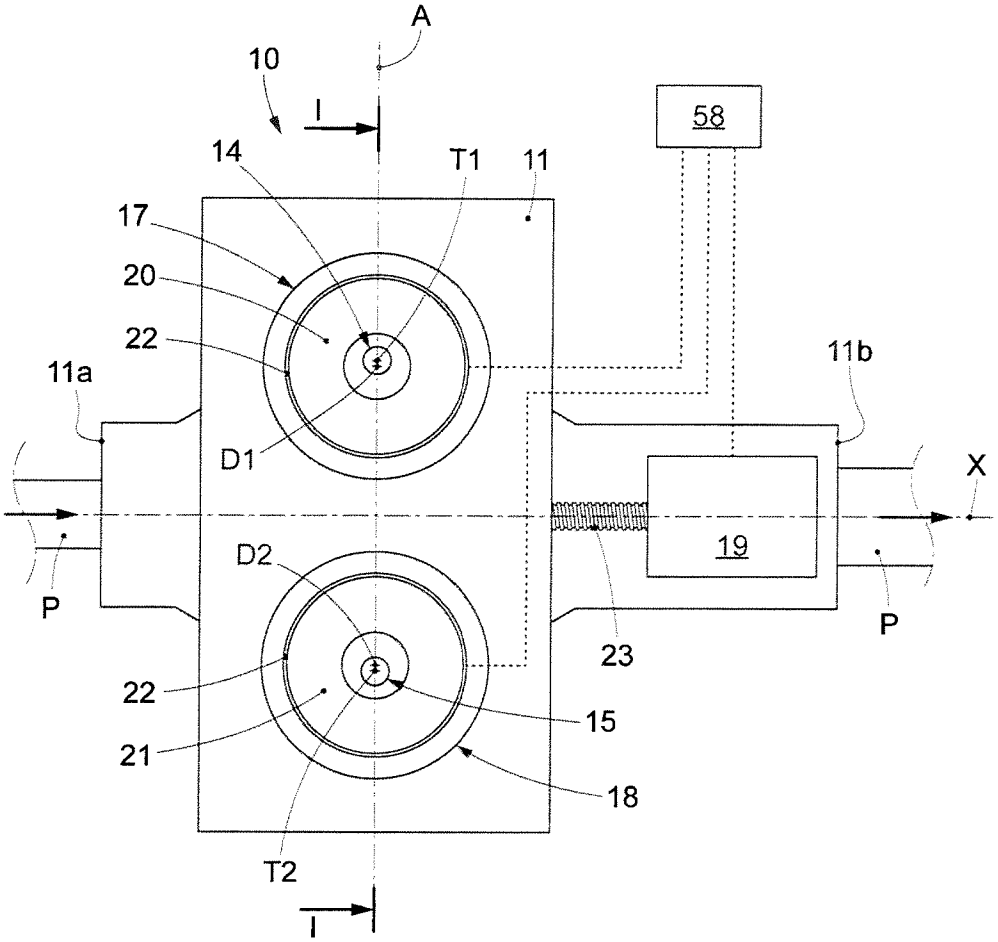
FIG. 2 is a lateral schematic representation of a torsion guide according to embodiments of the present invention.
Figure 1:
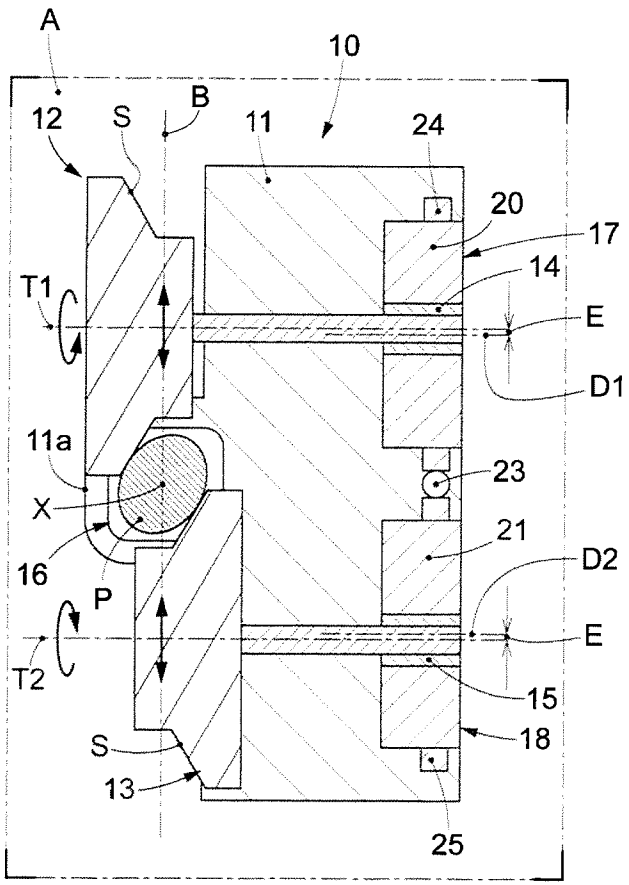
FIG. 1 is a schematic section view of a torsion guide according to embodiments of the present invention.

To facilitate comprehension, the same reference numbers have been used, where possible, to identify identical common elements in the drawings. It is understood that elements and characteristics of one embodiment can conveniently be combined or incorporated into other embodiments without further clarifications.

DETAILED DESCRIPTION OF SOME EMBODIMENTS

We will now refer in detail to the possible embodiments of the invention, of which one or more examples are shown in the attached drawings, by way of a non-limiting illustration. The phraseology and terminology used here is also for the purposes of providing non-limiting examples.

With reference to the attached drawings, the number 10 indicates a torsion guide according to some embodiments of the present invention. This torsion guide 10 can be used in a rolling plant 50 comprising two or more rolling stands 51, 52 located in succession along a rolling axis X.

During use, the torsion guide 10 receives at entry a metal product P, exiting from a first rolling stand 51, in order to give it a first torsion that allows it to spontaneously reach a desired total torsion at the entrance of the next rolling stand 52.

Twisting the metal product P at exit from a rolling stand 51 and before it enters the next 52 is of particular importance because, after rolling, the metal product P has an oval cross section, characterized by a major axis and a minor axis offset with respect to each other by about 90°. The torsion guide 10 therefore allows to position the metal product P preferably with the major axis perpendicular to the rotation axis of the rollers, or cylinders, of the next rolling stand 52.

Purely by way of example, in the case of two successive rolling stands 51, 52 3 meters apart, the torsion guide 10 can be placed between them at ⅙ of such distance and can give the metal product P a first torsion of about 15°. In the remaining ⅚ of the distance, the metal product P will spontaneously position itself until it reaches a total torsion of about 90° at the entrance of the second rolling stand 52.

In accordance with some embodiments, the torsion guide 10 comprises a support body 11 provided with an inlet 11*a* and an outlet 11*b* for a metal product P, which are aligned along a rolling axis X.

Two torsion rollers 12, 13 are associated with the support body 11, which preferably have an inclined profile S which gives the rollers 12, 13 a shape that is at least partly conical. These torsion rollers 12, 13 are disposed in such a way as to be converging, or conical, in substantially opposite directions. In other words, the direction in which one torsion roller 12 has the reduction in diameter is substantially opposite to the direction in which the other torsion roller 13 has the reduction in diameter.

Alternatively, the torsion rollers 12, 13 can be cylindrical in shape and be disposed suitably inclined, for example by means of respective support heads, in such a way as to give a desired first torsion to the metal product P which, during use, contacts them.

The torsion rollers 12, 13 are rotatable around respective rotation axes T1, T2 and are associated with respective mobile support elements 17, 18.

In some embodiments, the torsion rollers 12, 13 are pivoted to respective rotation supports 14, 15 which define their rotation axes T1, T2, and each rotation support 14, 15 can be disposed on a respective support element 17, 18.

According to some embodiments, the rotation axes T1, T2 of the torsion rollers 12, 13 are substantially parallel and belong to a common plane A perpendicular to the rolling axis X.

The two torsion rollers 12, 13 can be overlapping and distanced from each other in a direction of adjustment B perpendicular to the rotation axes T1, T2 and to the rolling axis X.

Furthermore, the torsion rollers 12, 13 can be distanced from each other also in a direction parallel to the rotation axes T1, T2. This conformation allows to define a passage gap 16 for the metal product P between the torsion rollers 12, 13.

In some embodiments, at least one torsion roller 12, 13 is mobile with respect to the other in the direction of adjustment B in order to modify a size of the passage gap 16.

According to one aspect of the invention, the torsion guide 10 comprises at least one motor mean 19 mechanically connected to at least one of the support elements 17, 18 in order to selectively move it.

In some embodiments, to the movement of a support element 17, 18 there corresponds a translation of the respective torsion roller 12, 13 at least in a direction parallel to the direction of adjustment B.

According to preferred embodiments, the motor mean 19 is mechanically connected to both support elements 17, 18 in such a way as to be able to move them selectively and in a coordinated way. In this case, to the movement of the support elements 17, 18 there corresponds a translation of the torsion rollers 12, 13 at least in a direction parallel to the direction of adjustment B. Furthermore, the extent of this translation can be the same for each torsion roller 12, 13 but with the opposite sense, determining a reciprocal movement of the torsion rollers 12, 13 toward/away from each other.

The torsion guide 10 can also comprise one or more means 22 for detecting the reciprocal position of the torsion rollers 12, 13. These detection means 22 directly or indirectly detect the relative or absolute position of the torsion rollers 12, 13, for example with respect to a known point of the torsion guide 10. In particular, the detection means 22 are configured to detect the reciprocal position of the torsion rollers 12, 13 at least in a direction parallel to the direction of adjustment B.

In some embodiments, the detection means 22 are directly associated with the torsion rollers 12, 13. In other embodiments, the detection means 22 are associated with the rotation supports 14, 15. In further embodiments, the detection means 22 are associated with the support elements 17, 18.

The detection means 22 can be configured to transmit the data relating to the positions of the torsion rollers 12, 13 to a control and management unit 58.

The control and management unit 58 can be configured to analyze the data received from the detection means 22 and to manage the operation of the at least one motor mean 19 on the basis of such data. In particular, the control and management unit 58 can drive the motor mean 19 to move the support elements 17, 18 in order to reciprocally position the torsion rollers 12, 13 at a desired distance along the adjustment axis B.

In this specific case, each support element 17, 18 comprises a disk 20, 21 rotatable around a rotation axis D1, D2 parallel to the rotation axes T1, T2 of the torsion rollers. On each disc 20, 21 there is eccentrically disposed a respective rotation support 14, 15 to which a torsion roller 12, 13 is pivoted. With each disc 20, 21 there is also associated a toothed wheel 24, 25 that engages a common grub screw 23, interposed between the disks 20, 21 and movable by the motor mean 19. This conformation allows to rotate the disks 20, 21 in opposite senses, making the grub screw 23 rotate.

By virtue of the eccentric disposition of the rotation supports 14, 15 on the discs 20, 21, with the rotation of the discs 20, 21 described above there corresponds a translation of the torsion rollers 12, 13, at least in a direction parallel to the adjustment axis B.

The eccentricity E can be identified as the distance between the rotation axis T1, T2 of a torsion roller 12, 13 and the rotation axis D1, D2 of the disc 20, 21 on which it is disposed.

In some embodiments, the eccentricity E is substantially the same for both the support elements 17, 18. Furthermore, the support elements 17, 18 and the rotation supports 14, 15 can be disposed symmetrically with respect to the rolling axis X (FIG. 2). This allows to move the torsion rollers 12, 13 toward/away from each other in the direction of adjustment B by means of the motor mean 19, always keeping them equidistant from the rolling axis X.

In some embodiments, the detection means 22 can comprise transducers of the angular position of the discs 20, 21. For example, an angular position transducer can be associated with each disc 20, 21 configured to transmit data, relating to the angular position of the disc 20, 21 with which it is associated, to the control and management unit 58. Advantageously, in this way, the control and management unit 58 can command the motor mean 19 on the basis of the data transmitted by the transducers of the angular position of the discs 20, 21.

The control unit 58 can also be configured to receive inputs from an operator and to command the motor mean 19 as a function of such inputs. In particular, the control and management unit 58 can comprise a user interface provided with any known communication device whatsoever, such as for example keys, keyboards, touchscreen devices, and/or devices for communication with computer networks.

Purely by way of example, an operator can communicate the desired distance between the torsion rollers 12, 13 along the adjustment axis B to the control and management unit 58. Then, as a function of the input received and of the data relating the position of the torsion rollers 12, 13, the control and management unit 58 can drive the motor mean 19 in order to position the torsion rollers 12, 13 as desired by the operator.

Advantageously, this conformation limits the interventions of the operators on the torsion guide 10, making its setting faster and more effective. This is particularly advantageous in the case of rolling trains with different rolling passes, for example 20 or more, where a torsion guide 10 is placed for each pass.

Figure 3:
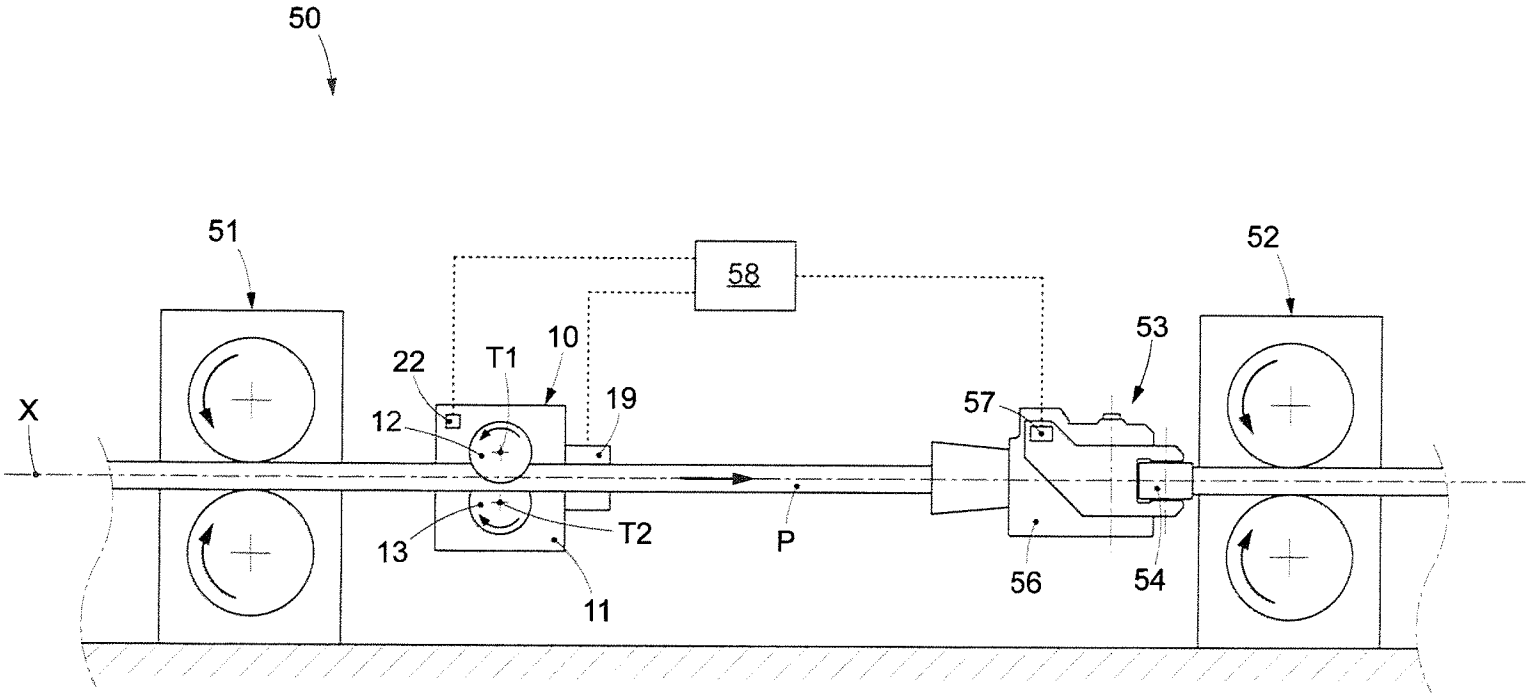
FIG. 3 is a lateral schematic representation of a rolling plant according to the present invention.

With reference to FIG. 3, the present invention also concerns a rolling plant 50 comprising at least two rolling stands 51, 52 disposed in succession along a rolling axis X and a torsion guide 10, according to the present invention, interposed between the two rolling stands 51, 52.

In preferred embodiments, the rolling plant 50 can also comprise a rolling guide 53 interposed between the two rolling stands 51, 52 and downstream of the torsion guide 10. The rolling guide 53 is preferably placed in correspondence with the entrance of the rolling stand 52 downstream of the torsion guide 10. The rolling guide 53 keeps the metal product in the correct work position in line with the gap defined between the rollers or cylinders of the rolling stand 52 downstream thereof.

The rolling guide 53 comprises at least one pair of guide rollers 54 mounted on a support body 56 and having rotation axes orthogonal to the rolling axis X.

The guide rollers 54 are normally idle and kept constantly in contact with the metal product from which they receive, by friction, the rotational motion. The rolling guide 53 also comprises one or more means 57 for detecting the force that the metal product P applies, during use, to the guide rollers 54. For example, with each guide roller 54 of the rolling guide 53 there can be associated a respective force detection mean 57. These detection means 57 can be of any known type and can be directly associated with the respective guide roller 54 or, alternatively, with elements connected to the guide roller 54, for example support arms (FIG. 3).

The force detection means 57 are also configured to transmit the detected force values to a control and management unit 58 which commands at least one motor mean 19 of the torsion guide 10.

In some embodiments, the control and management unit 58 is configured to analyze the data received from the detection means 57 of the rolling guide 53 and command the motor mean 19 of the torsion guide 10 as a function thereof.

In fact, the values of the force applied by the metal product P to the guide rollers 54 of the rolling guide 53 can vary as a function of the wear of the torsion rollers 12, 13 of the torsion guide 10. In other words, worn torsion rollers 12, 13 do not give a correct first torsion to the metal product P, which enters the next rolling guide 53 positioned incorrectly, for example pressing on one guide roller 54 more than on the other.

By way of example only, if the control and management unit 58 detects a significant difference in the force applied by the metal product P to one guide roller 54 compared to the other, it can move the torsion rollers 12, 13 toward/away from each other until the values of the force applied to the guide rollers 54 are within preset acceptance ranges.

Therefore, the rolling plant 50 of the present invention allows to automatically adjust, even during use, the reciprocal positioning of the torsion rollers 12, 13 of the torsion guide 10. Advantageously, the rolling plant 50 of the present invention allows to prevent blockages, malfunctions, defects of the final product and limits the frequent, burdensome and invasive maintenance linked to the wear of the torsion rollers 12, 13.

The present invention also concerns a rolling method which provides to:

- reduce the thickness of a metal product P by means of a first rolling stand 51;
- transmit a first torsion to the metal product P at exit from the first rolling stand 51 by means of two torsion rollers 12, 13 of a torsion guide 10;
- directly or indirectly detect the wear of the torsion rollers 12, 13;
- automatically adjust the reciprocal positioning of the torsion rollers 12, 13 of the torsion guide 10 on the basis of the wear detected.

In preferred embodiments of the method, the detection of the wear of the torsion rollers 12, 13 can occur by means of a control and management unit 58 which analyzes data transmitted by means 57 for detecting the force applied by the metal product P to one or more guide rollers 54 of a rolling guide 53 located downstream of the torsion guide 10.

Furthermore, in other embodiments, the adjustment of the reciprocal positioning of the torsion rollers 12, 13 of the torsion guide 10 can occur by means of the control and management unit 58, which selectively drives a motor mean 19 associated with the torsion rollers 12, 13. In particular, the drive of the motor mean 19 can occur as a function of the data transmitted by the detection means 57.

It is clear that modifications and/or additions of parts or steps may be made to the torsion guide 10, to the rolling plant 50 and to the rolling method as described heretofore, without departing from the field and scope of the present invention as defined by the claims.

In the following claims, the sole purpose of the references in brackets is to facilitate reading they must not b e considered as restrictive factors with regard to the field of protection claimed in the specific claims.

The invention claimed is:

1. A torsion guide usable in a rolling plant comprising:

two of more rolling stands located in succession along a rolling axis;

a support body;

at least two support elements connected to the support body;

at least one motor means connected to the at least two support elements, the at least one motor means configured to move the at least two support elements in at least in a direction of adjustment;

at least two torsion rollers connected to a respective one of the at least two support elements, the at least two torsion rollers rotatable around respective rotation axes parallel to each other and perpendicular to the rolling axis, wherein the at least two torsion rollers overlap each other when viewed in the direction of the adjustment perpendicular to the rotation axes and the rolling axis, and are distanced from each other in the direction of adjustment;

a control and management unit;

one or more detection means for detecting a reciprocal position, with respect to each other, of the at least two torsion rollers at least in the direction of adjustment, the detection means being configured to transmit data correlated to reciprocal position of the at least two torsion rollers to the control and management unit in order to adjust the reciprocal position of the at least two torsion rollers at least in the direction of adjustment, wherein the support elements each include a disc rotatable around a respective axis of rotation and on which a respective torsion roller of the at least two torsion rollers is eccentrically pivoted by means of a rotation support.

2. The torsion guide of claim 1, wherein the at least one motor means is mechanically connected to the support elements to move them selectively and in a coordinated manner, and wherein a movement of the support elements there is a corresponding reciprocal movement of the at least two torsion rollers toward/away from each other.

3. The torsion guide of claim 1, wherein the support body is provided with an inlet and an outlet for a metal product which is aligned along the rolling axis, wherein the support elements are disposed symmetrically with respect to the rolling axis.

4. The torsion guide of claim 1, wherein the control and management unit is configured to command a functioning of the at least one motor means at least as a function of the data correlated to the position of the at least two torsion rollers in order to adjust the reciprocal position thereof at least in the direction of adjustment.

5. The torsion guide of claim 1, wherein the discs are integral with respective toothed wheels which engage a common grub screw element which can be driven by the at least one motor means, and wherein the detection means comprise angular position transducers to determine an angular position of the discs.

6. A guide apparatus for use in a rolling plant, the guide apparatus comprising:

at least one torsion guide;

two or more rolling stands, disposed along a rolling axis;

a rolling guide disposed downstream of the torsion guide along the rolling axis, wherein the torsion guide includes:

a support body;

support elements connected to the support body;

at least one motor means connected to the support elements, the at least one motor means configured to move the support elements in at least in a direction of adjustment;

at least two torsion rollers connected to a respective support element of the support elements and being rotatable around a respective rotation axes and parallel to each other, wherein the at least two torsion rollers overlap each other when viewed in the direction of adjustment perpendicular to the rotation axes and the rolling axis, and are distanced from each other in the direction of the adjustment;

a control and management unit; and one or more detection means for detecting a reciprocal position of the at least two torsion rollers with respect to each other at least in the direction of the adjustment, wherein the detection means is configured to transmit data correlated to the reciprocal position of the at lest two torsion rollers to the control and management unit in order to allow adjustment of the reciprocal position of the at least two torsion rollers at least in the direction of the adjustment, and wherein the rolling guide comprises:

at least two guide rollers; and a force detection means for detecting a force applied by a metal product in transit on the at least two guide rollers, wherein the force detection means for detecting the force applied by a metal product in transit on the at least two guide rollers is configured to transmit data relating to the force applied to the at least two guide rollers to the control and management unit, and wherein an adjustment of the reciprocal position of the at least two torsion rollers is subjected to the detection of the force by the force detection means.

7. A rolling plant comprising:

at least two horizontal axis rolling stands which are disposed in succession along a rolling axis;

at least one torsion guide placed between the at least two rolling stands, the torsion guide comprising:

a support body;

support elements connected to the support body;

at least one motor means connected to the support elements, the at least one motor means configured to move the support elements in at least in a direction of adjustment;

at least two torsion rollers connected to a respective support element of the support elements and being rotatable around a respective rotation axes parallel to each other, wherein the at least two torsion rollers overlap each other when viewed in the direction of adjustment perpendicular to the rotation axes and the rolling axis, and are distanced from each other in the direction of the adjustment;

a control and management unit;

one or more detection means for detecting the reciprocal position of the at least two torsion rollers at least in the direction of adjustment, the detection means being configured to transmit data correlated to the reciprocal position of the at least two torsion rollers to the control and management unit in order to allow to adjust the reciprocal position of the torsion rollers at least in the direction of adjustment; and at least one rolling guide, placed downstream of the torsion guide and upstream of one of the rolling stands, the rolling guide comprising:

at least two guide rollers; and one or more force detection means for detecting a force that, during use, a metal product applies to the at least two guide rollers, wherein the force detection means is configured to transmit data relating to the force applied to the at least two guide rollers to the control and management unit.

8. The rolling plant of claim 7, wherein the control and management unit is also configured to command the at least one motor means of the torsion guide on the basis of the data received from the force detection means of the rolling guide in order to adjust the reciprocal position of the at least two torsion rollers at least in the direction of adjustment.

9. A rolling method for rolling a metal product along a rolling axis comprising:

reducing a thickness of the metal product by means of a first rolling stand;

transmitting a first torsion to the metal product at exit from the first rolling stand by means of a torsion guide provided with at least two torsion rollers which are rotatable around respective rotation axes parallel to each other and perpendicular to the rolling axis and connected to respective support elements which are movable at least in a direction of adjustment and are mechanically connected to at least one motor means, detecting, via a control and management unit and one or more detection means, a reciprocal position of the at least two torsion rollers at least in the direction of adjustment, which are configured to transmit data correlated reciprocal position of the at least two torsion rollers to the control and management unit;

directly or indirectly detecting a wear of the at least two torsion rollers;

automatically adjusting the reciprocal position of the at least two torsion rollers, at least in in the direction of adjustment, on the basis of the detection of the wear of the at least two torsion rollers, wherein the detecting the wear of the at least two torsion rollers occurs by a force detection means of the control and management unit which analyzes data transmitted by the force detection means applied by the metal product to one or more guide rollers of a rolling guide located downstream of the torsion guide.

10. The method of claim 9, wherein automatically adjusting the reciprocal position of the at least two torsion rollers includes moving the at least two torsion rollers the by the at least one motor means commanded by the control and management unit.

* * * * *